United States Patent [19]

Kelley

[11] 4,310,750

[45] Jan. 12, 1982

[54] TACTICAL NUCLEAR SLIDE RULE FOR A PLURALITY OF ENVIRONMENTS

[75] Inventor: Clair S. Kelley, Reston, Va.

[73] Assignee: The United States of America as represented by the Secretary of the Army, Washington, D.C.

[21] Appl. No.: 938,560

[22] Filed: Aug. 31, 1978

[51] Int. Cl.[3] ..... G06G 1/02

[52] U.S. Cl. ..... 235/70 A

[58] Field of Search ..... 235/70 R–70 C, 235/85 R, 85 FC, 89 R

[56] References Cited

U.S. PATENT DOCUMENTS

| | | | |
|---|---|---|---|
| 1,150,771 | 8/1915 | Keuffel | 235/70 B |
| 3,232,531 | 2/1966 | Hodge, Jr. | 235/70 R |
| 4,124,795 | 11/1978 | LiCalsi | 235/89 R X |

*Primary Examiner*—L. T. Hix

*Assistant Examiner*—Benjamin R. Fuller

*Attorney, Agent, or Firm*—Nathan Edelberg; Robert P. Gibson; Saul Elbaum

[57] ABSTRACT

A calculational aid is provided, in the form of a slide rule, to facilitate calculation of probable damage inflicted by a nuclear detonation. The particular apparatus permits calculation of any one or more of several damage-causing environments induced by nuclear detonations, and the consequential probability of damage resulting from such a detonation caused by the particularly calculated environment. Appropriate scales, properly spaced in particular relationships, are provided on a slide rule, thus providing a means for performing the calculational functions described above. Each of the possible environment-related damage calculations utilizes five parameters, and the present invention provides an apparatus for determining any one of the five parameters once the other four are known.

6 Claims, 2 Drawing Figures

TACTICAL NUCLEAR SLIDE RULE FOR A PLURALITY OF ENVIRONMENTS

RIGHTS OF THE GOVERNMENT

The invention described herein may be manufactured, used, and licensed by or for the U.S. Government for governmental purposes without the payment to me of any royalty thereon.

BACKGROUND OF THE INVENTION

1. Related Applications

A co-pending application, Ser. No. 928,219 filed July 26, 1978, of the present inventor, entitled "Tactical Nuclear Slide Rule," discloses a slide rule for computation of an environmental parameter and of the probability of damage and response to that environment.

2. Field of the Invention

The present invention relates to calculational devices, and more particularly to apparatus having indicia and scales properly placed thereon to enable the computation of specific functions relating to probability of damage resulting from a nuclear explosion.

The present apparatus combines a means for computation of any one or more particular environmental parameters for a detonation with a further means for computing a probability of damage responsive to the computed environmental parameters.

3. Prior Art

Prior art computational devices are known, particularly in the form of slide rules. However, such devices are not available for the computation of the parameters and probabilities hereinabove described.

Thus, while algorithms are known for computation of static overpressure, for example, resulting from a nuclear detonation, given the particular weapon yield, distance from the detonation and two vulnerability parameters, (see William E. Sweeney, Jr., Cyrus Moazed, and John S. Wicklund, Nuclear Weapons Environments for Vulnerability Assessments To Support Tactical Nuclear Warfare Studies (U), Harry Diamond Laboratories TM-77-4 (June, 1977). (CONFIDENTIAL)), no single device is known to enable computation of the parameters as herein described, and particularly to compute the probability of damage. Prior art calculation of such answers requires the utilization of complex electronic computing devices, involving the expenditure of significant amounts of time and funds for the programming thereof. Step-by-step solutions utilizing calculators are also available but again require expenditure of time in the solution of the equation. While a prior art computing apparatus is available for calculating an environmental parameter resulting from a nuclear detonation, the device does not provide any means for utilizing the resultant parameter to compute the probability of damage as provided by the present apparatus.

BRIEF DESCRIPTION OF THE DRAWINGS

These and other objects, features, and advantages of the present invention will become more readily apparent from the following specification and appended claims, when considered in conjunction with the attached drawings, in which:

SUMMARY AND OBJECTS OF THE INVENTION

Figure 1:
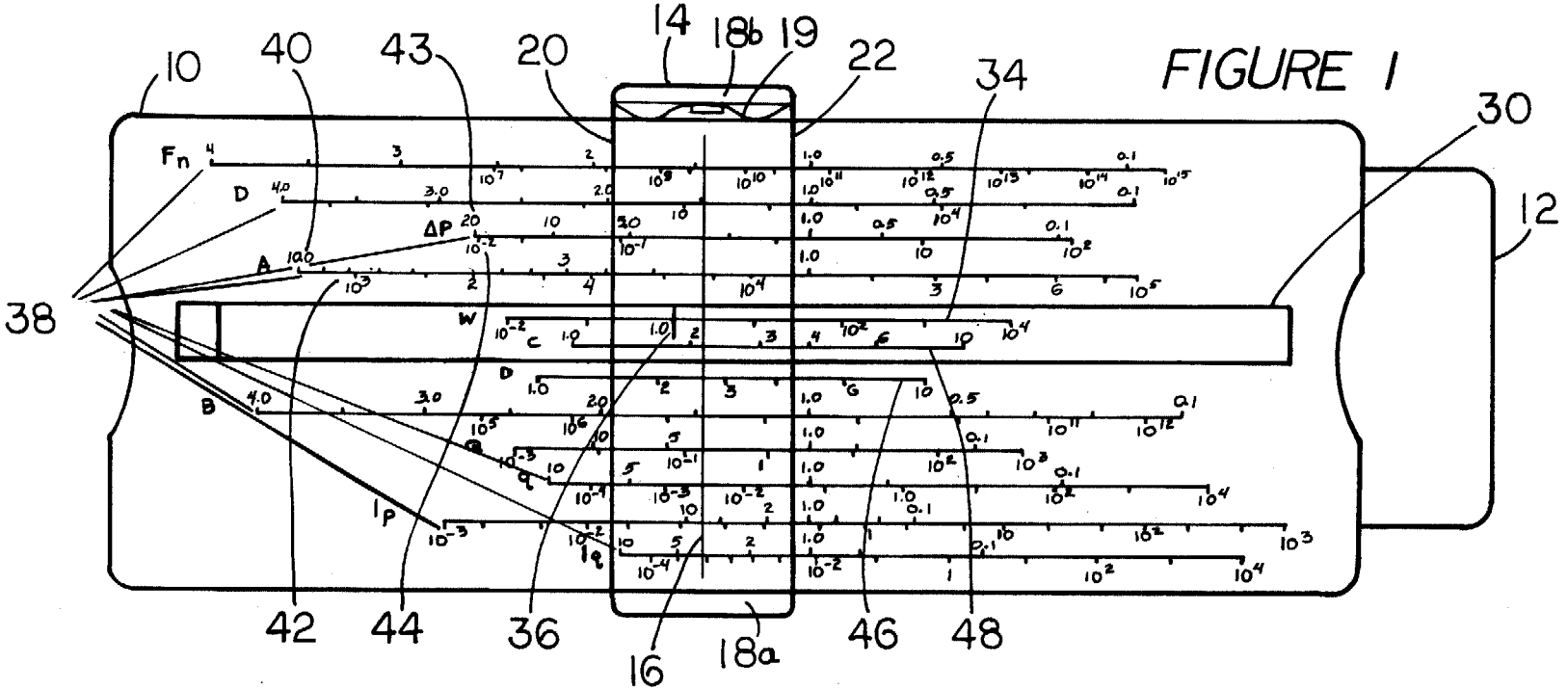
FIG. 1 shows a front view of the present inventive slide rule.

In accordance with the present invention, a slide rule is provided having a slide, a stationary body and a movable cursor.

The front face of the slide includes a graduated scale displaying the yield of the particular weapon, and a second scale is provided for performance of a division operation utilizing a vulnerability parameter pertaining to the relative intensity of the computed environmental parameter.

The front face of the stationary part of the slide rule includes a plurality of scales, each used for the calculation of a particular environmental parameter. The scales needed to compute the particular environments are combined, so that graduations and indicia are provided both above and below a scale line. That is, two scales are combined for each environment. A first scale relates to distance of the item from the burst site, and a second scale displays the intensity of the particular environment. Utilization of individual distance scales for each parameter provides an advantage described below. Additionally, a convenience scale is provided on the stationary part for performing the division operation in cooperation with the second scale on the slide, previously described.

The back of the slide rule includes scales utilized to compute the probability of damage to an item experiencing the environment calculated on the front face. Thus, scales are provided on the stationary part for displaying the result of the division operation previously described, as well as of the computed probability of damage. A scale displaying a second vulnerability parameter, relating to the way the probability result changes upon changes in the environmental parameter, is provided on the back of the slide for cooperation with the scale displaying the result of the division in computing the desired probability of damage.

In accordance with the above description, it is an object of the invention to overcome the difficulties found in the prior art in computation of the various environments of a nuclear detonation and of the resulting probabilities of damage.

It is a primary object of the invention to provide an apparatus for computing the probability of damage to an object situated at a particular distance from a detonation site, given environmental parameter data.

It is another object of the invention to provide a means for computing one or more environmental parameters for use in the calculation of the probability of damage.

Yet another object of the invention is the provision of a slide rule for performing the above calculations.

A further object of the invention is the provision of a calculating device for determining any one of five parameters utilized in an equation, given the other four.

Another object of the invention is the provision of a slide rule for computation of environments of a nuclear detonation wherein all the environments may be read simultaneously for a particular, standard distance from the blast site.

Still another object of the invention is to provide a slide rule wherein a plurality of scales are so displaced and scaled as to provide a common reference point and enable simultaneous solution of a plurality of equations.

It is an additional object of the invention to provide a slide rule having a plurality of scales so aligned as to permit simultaneous solution of a plurality of equations in a single step.

Yet another object of the invention is the provision of a slide rule specifically for the solution of a plurality of equations with individual scales corresponding to individual ones of the plurality of equations.

It is still a further object of the invention to provide means for calculating one of a variety of answers to an equation without requiring reprogramming for each such solution.

Still another object of the invention is the provision of a computing apparatus for the probability of nuclear damage wherein the operator may readily retrace the steps to permit viewing the individual parameters utilized in the process of solution.

DETAILED DESCRIPTION OF A PREFERRED EMBODIMENT

Figure 2:
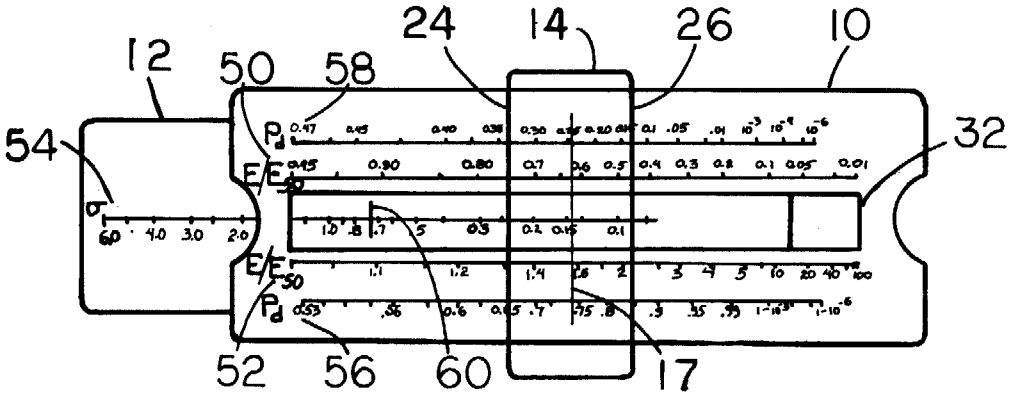
FIG. 2 shows a back view of the inventive slide rule.

In accordance with the above-described objects of the invention, a slide rule is provided as shown in FIGS. 1 and 2 of the drawing.

The slide rule comprises a stationary portion 10 combined and cooperating with a slide 12. The slide rule further comprises a transparent cursor 14 having two hairlines thereon, 16 and 17 respectively associated with the front and back face of the slide rule. Bottom side 18*a* of cursor 14 is biased against stationary portion 10 by a spring 19 included in top side 18*b* of the cursor.

It is appreciated, of course, that a hairline need not be used, and that the cursor, shown as transparent in FIGS. 1 and 2, may merely be an opaque marker. Thus, edge 20 of the cursor may be used in the computations, as well as edges 22, 24 and 26.

Additionally, it is understood that a spring is not essential to the operation of the present device, and that the spring may be associated with side 18*a* instead of, or along with, the spring 19.

It is further associated that scales described as being on the slide may be placed on the stationary portion, and those described as being on the stationary portion may be on the slide.

The slide rule further contains on the front face thereof a window 30 for display of the scales associated with slide 12. It is recognized that the scales may be arranged in any order, and that accordingly a plurality of windows may be used on the front face of stationary part 10 for display of any and all scales shown on the slide.

The back face of stationary part 10 similarly includes a window 32 for display of indicia associated with the back of slide 12.

The slide rule portions further include several scales, which may be engraved or printed on the slide and the stationary part or otherwise associated therewith, the scales having particular relationship as described in the sequel.

Referring now to FIG. 1 specifically, a first scale 34 is shown associated with slide 12 for display in window 30 of stationary portion 10. The particular scale is shown as having a label W, and pertains to a weapon yield W in kilotons. The scale 34 has associated therewith an index 36, which is used in the manner described below.

Stationary part 10 has thereon a plurality of scales 38. Each of the scales 38 shown in the figure includes a first portion 40 comprising a first set of numerals and indices placed above the scale line, and a second portion 42 comprising a second set of numerals and indices placed below the scale line. The two portions are labeled 40 and 42 for one scale only, but are seen to be associated with all but one scale on the front face of stationary part 10. The first portion of each scale displays for computation the distance, R, of the item from the burst site and the second portion displays the environmental parameter value. The specific distance scales of the presently preferred embodiment are graduated in kilometers. It is recognized that any of the scale factors utilized herein may be changed, as is known to those skilled in the art, upon a proper and appropriate change in the display numbers and their placement. Thus, R may be measured in miles, feet, meters or any other distance-measuring parameter upon appropriately changing the values of the numerical indications adjacent the scale. Similarly, W may be shown in megatons rather than kilotons, or in any other convenient factor, upon similar appropriate changes in the display numerals. It is also appreciated that the distance scales need not all be above the scale line. Some or all may be below the line or a single scale may serve as a distance scale for several of the environmental parameters.

As shown in the present embodiment, the W scale 34 is graduated in an increasing logarithmic scale, while the distance scales are shown as decreasing logarithmic scales, when both scales are viewed from left to right. Of course, the scales may instead decrease, and increase, respectively. It is of no consequence to the basic scope of the invention that the increase take place from left to right or right to left. What is important is that the scales increase in opposite directions.

The first portions 40 on the front face of stationary part 10 in combination with second portions 42 form the individually labeled environment scales 38, symbolizing the environmental parameters to be calculated. Specifically, an environment is calculated by the manipulation of slide 12 within the stationary part 10, and a subsequent adjustment of cursor 14.

It is noted that the numerical indicia on scales 42 increase in the same direction as those on scale 34, which is opposite to the direction of increase of the indicia on scales 40.

Finally, scales 46 and 48 are provided on portions 10 and 12, respectively, increasing in the same direction and being similarly scaled thereto. The function of scales 46 and 48 is to perform a division in the manner of ordinary scales D and C of a standard slide rule. Specifically, scale 48 provides a divisor for a dividend shown on scale 46. The quotient is calculated and displayed on scale 46.

Operation of the scales hereinabove described is as follows.

To calculate the environment shown on one of scales 38, say on scale 42, of an object located a particular distance away from a weapon having a predetermined yield, the index 36 found on yield scale 34 is aligned with the particular distance parameter as located on scale 40. This may be done with the aid of hairline 16 on cursor 14. Cursor 14 is then displaced until hairline 16 is aligned with the actual weapon yield on scale 34, and the environmental parameter, specifically the vertical electromagnetic pulse peak field intensity, in volts per meter, is read under hairline 16 on scale 42 labeled "A" in the figure.

In addition to the environment associated with scale 42, the other major damage-causing, nuclear-induced environments are:

| | |
|---|---|
| neutron fluence | $F_n$(n/cm$^2$) |
| total radiation dose | D(rad) |
| static overpressure | ΔP(psi)[4] |
| thermal fluence | Q(cal/cm$^2$) |
| peak ideal dynamic pressure | q(psi) |
| static pressure impulse | $I_p$(psi-s) |
| ideal dynamic pressure impulse | $I_q$(psi-s) |
| and peak gamma dot | B(radSi/sec) |

Scales for these environments appear on the front face of stationary part 10 of the present invention.

It is found that the expression describing the environmental parameter in terms of distance from the detonation and weapon yield is approximated by the following equation:

$$E = AW^B R^{-C} e^{-DR}$$

The expression essentially identifies the environment, E, as a function of weapon yield, W, and distance from the detonation site, R, and includes therein four parameters, A, B, C, and D.

The following table provides the values of the parameters associated with the respective environments.

| E | A | B | C | D |
|---|---|---|---|---|
| A = $E_{74}$ | $1.39 \times 10^4$ | 0.215 | 1.28 | 0 |
| B = $\gamma_P$ | $6.45 \times 10^9$ | 0.897 | 2.79 | 3.11 |
| $F_n$ | $4.82 \times 10^{12}$ | 1 | 2.00 | 4.44 |
| D | 8,528 | 1 | 2.485 | 3.572 |
| ΔP | 1.61 | 0.567 | 1.70 | 0 |
| Q | 2.88 | 1 | 1.99 | 0.116 |
| $I_p$ | 0.351 | 0.604 | 0.813 | 0 |
| q | $6.33 \times 10^{-2}$ | 1.09 | 3.28 | 0 |
| $I_q$ | $9.88 \times 10^{-3}$ | 1.146 | 2.44 | 0 |

An example of the equations involved in the computation of the environmental parameters is the relationship between yield, distance and pressure parameters, as given below:

$$\Delta P = 1.61 W^{0.567} (R^{-1.70})$$

In prior art devices an attempt to solve the present equation for ΔP would require the raising of a particular number, corresponding to the distance from the blast site, to a first (negative) power, multiplying the result by a second number (corresponding to the weapon yield) raised to a second power, and multiplying the product by a constant, 1.61. While this can be done on an ordinary slide rule, each of the steps must be done separately, the numbers recorded, and finally a multiplication of the results performed, with all the inaccuracies implied therein. If the operation were to be performed on a calculator, again, each step needs to be done separately, the result stored, and a subsequent multiplication of the three factors performed. Such a computation, which loses the numbers being entered into the computation, is error-prone and time consuming. A programmed approach would permit calculation of the result of the equation by insertion of the parameters to determine the answer, but obviously requires the additional expenditures involved in purchasing a computer or a programmable calculator, and permits the computation to be carried in only one direction. That is, the converse calculation, of the required weapon yield when given a particular overpressure and distance, for example, necessitates the writing and implementation of a separate program. The present device overcomes the disadvantages mentioned and provides a display of the parameters entered to assure reliability, and moreover, does not require either storage of calculated data or generation of complex programs.

By way of illustration, the ΔP scale is obtained from the previously obtained transcendental equation for ΔP by conversion to the following form:

$$\ln \Delta P - \ln 1.61 = 0.567 \ln W + 1.7 \ln (R^{-1}).$$

The relationships between the individual scales on the present slide rule are selected to provide the particular coefficients shown in the preceding equation, and further to provide for the proper relationship between weapon yield and distance.

That is, the distance scale 43 for the pressure scale ΔP, shown at 44, is selected to be in a negative direction, or in a decreasing direction from the left to right, to correspond with the negative power to which the distance is raised.

Further, in order to provide for solution of the present equation, the scales 34 and 43 are provided at scale factors having a ratio of 0.567 and 1.7 to that of scale 44. Finally, the scales are aligned so that scale 44 is displaced by a factor corresponding to the natural log of 1.61 from scales 34 and 43.

Inasmuch as the scale sets 43–44, 40–42, etc., may each be displaced arbitrarily with respect to scale 34, the preferred embodiment utilizes a displacement for each such scale set which aligns all the distance scales at some particular point. Specifically, R=1.0 KM is chosen. Thus, for a distance of 1 KM, all the environments are simultaneously calculated. That is, all the transcendental equations represented by the preceding table are solved simultaneously for the selected distance.

Proceeding with an illustrative example, the overpressure is desired for a weapon having a yield of three kilotons at a distance of 0.9 kilometers from the blast site. Accordingly, the hairline 16 is aligned with the distance of 0.9 on scale 43 and slide 12 moved until index 36 aligns with hairline 16. Cursor 14 is then moved until the hairline is aligned with the yield indication of 3 on scale 34, and the static overpressure of 3.6 psi found under hairline 16 on scale 44.

The purpose of scale 48, not previously discussed, is to provide a ratio of the computed environment, here static overpressure, to the particular environmental value at which an item will experience a probability of damage of 0.5 indicated by $E_{50}$. That is, a vulnerability parameter is injected into the computation for determination of the significance of the calculated environmental parameter, and the ratio of the two is utilized to obtain the ultimate probability of damage.

In the present example, the vulnerability parameter, $\Delta P_{50}$, is 2.4 psi. It is then determined that ΔP is in the ratio of 1.5 to $\Delta P_{50}$. This is done by entering the computed environmental parameter on scale 46, the D scale, and the vulnerability parameter on scale 48, the C scale, and obtaining the ratio in the normal manner of usage of slide rules.

Vulnerability parameters are obtained from the Defense Nuclear Agency Vulnerability Array. See William L. Vault and William E. Sweeney, Jr., Vulnerability Data Array Progress Report—FY76, FY7T (U), Harry Diamond Laboratories PR-77-3 (December 1977) (CONFIDENTIAL), and a report on Nuclear Damage to Point Targets, by C. Stuart Kelley, Stacy E. Gehman, John H. Wasilik, and William D. Scharf to be published as a Harry Diamond Laboratories Technical Report.

Turning now to FIG. 2, scales 50 and 52 are shown on the back of stationary part 10, representing the ratio obtained in the last step of the calculation performed with the scales of the front portion of the slide rule. A further scale 54, on the back side of the slide 12, is utilized to perform a computation raising the determined ratio to a specific power, the resultant being again found on scales 50 and 52. Finally, scales 56 and 58 are provided to convert the resultant, previously found on scales 50 or 52, to the desired answer, $P_d$.

Specifically, having computed the environmental ratio $\Delta E/\Delta E_{50}$, the probability of damage can be found from the following equation:

$$P_d = 0.5\ \{1 + erf([\ln(\Delta E/\Delta E_{50})]/\sqrt{2}\ \sigma)\}$$

The first computation, involving scales 50, 52 and 54, is used to obtain a result $$Q = (\Delta E/\Delta E_{50})^{1/\sqrt{2}\ \sigma}$$

and the scales 56 and 58 used to convert that result, (Q), to $$P_d = 0.5(1 + erf \ln a)$$

The procedure for computation of $P_d$ is as follows:

The value of $E/E_{50}$ is entered on the appropriate one of scales 50 and 52. The second vulnerability parameter, sigma, is inserted into the equation by aligning the index 60, found on scale 54, with the entry on scale 50 or 52, possibly with the aid of hairline 17. The hairline is then shifted to be aligned with the value of sigma found in the vulnerability array and displayed on scale 54. The probability of damage, $P_d$ is now read from scales 56 or 58, corresponding to scales 52 or 50 used for entry of $E/E_{50}$, respectively.

To conclude the preceding example, the ratio $\Delta P/\Delta P_{50}$ was found to be 1.5. Entering the 1.5 number on scale 52 and moving index 60, on scale 54, to align with 1.5 on scale 52, one adjusts the hairline 17 to align with the value of the vulnerability parameter $\sigma$, relating to the way $P_d$ changes when $\Delta P$ changes, and finds a value for Q on scale 52. Specifically, for the present example, assuming sigma equals 0.4, upon placing index 60 adjacent 1.5 on scale 52 one finds that adjacent to $\sigma = 0.4$ on scale 54 is the number 2.05 on scale 52.

As is apparent to one skilled in the art, use of the present slide rule permits computation of any of the factors of the equation given the other factors. Thus given the vulnerability parameters and desired probability, either distance or yield may be determined when the other is known.

It is noted that if the ratio found with scales 46 and 48 were 0.7, rather than 1.5 one would enter that number on scale 50, align index 60 therewith, and find the answer adjacent the value of sigma on scale 50. The resultant probability would then be found on scale 58.

Unlike the previously identified co-pending application, the present apparatus does not require the user thereof to obtain a value for Q prior to finding the value of the desired probability. In part this elimination of a computing step is enabled by the provision of two probability scales, 58 and 56, aligned to correspond directly to the computed value of Q on scales 50 and 52. Thus, while applicant's co-pending application provides a single probability scale and a nomograph to convert from the computed value of Q to the desired probability, the present apparatus eliminates the possibility of error introduced by the computational step by providing scales 56 and 58, each aligned with its corresponding Q scale.

In accordance with the preceding specification, it has thus been shown that a means is provided for calculating the probability of damage to an item in reaction to a nuclear detonation. A single calculating means provides for computation of a plurality of environmental parameters upon determination of weapon yield and distance from the detonation site. The calculating means is so conceived as to provide simultaneous computation of all environmental parameters at a particular distance, independently of weapon yield.

Means is provided for computing a critical ratio of the environmental parameter to a first vulnerability parameter, and a further means provided to utilize a second vulnerability parameter with the critical ratio to compute the desired probability of damage.

The disclosed invention provides for straightforward, rapid and inexpensive calculation of the solution to a complicated equation, while simultaneously permitting the solution for any one of several parameters involved in the equation. Moreover, upon entering a parameter and moving to a next step, the parameter remains available for display.

The preceding specification describes, by way of illustration and not of limitation, a preferred embodiment of the invention. Inasmuch as the scope of the invention is recited with greater particularity in the following claims, I wish it to be understood that I do not desire to be limited to the exact details of construction shown and described, for obvious modifications can be made by a person skilled in the art.

What is claimed is:

1. Means for computing probability of damage to an item located a specified distance from a detonation site of a weapon having a predetermined yield comprising:

(a) stationary means, having a plurality of stationary means scales associated therewith, (b) slide means in sliding relationship with said stationary means and having a plurality of sliding means scales associated therewith, (c) said stationary means scales and said sliding means scales each comprising a plurality of indicia, (d) movable aligning means associated with said stationary means and with said slide means for aligning various indicia on the scales thereof, (e) one of said slide and stationary means having a first scale thereon representative of weapon yield, (f) the other of said slide and stationary means having a set of scales representative of a set of environmental parameters, (g) the other of said slide and stationary means having a set of distance scales thereon, each one of said distance scales being associated with one of said environmental parameter scales, respectively, and each of said distance scales being aligned in a predetermined manner with respect to the other said distance scales and with respect to said weapon yield scale whereby any one of said set of environmental parameters may be computed by aligning said scale representative of weapon yield with a selected one of said distance scales, displacing said movable aligning means to correspond to said predetermined weapon yield, and obtaining said any one environmental parameter from a corresponding one of said set of scales of said other of said slide and stationary means representative of such environmental parameter, adjacent said aligning means.

2. Calculating means as recited in claim 1 wherein:

(a) said one of said slide and stationary means has a second scale associated therewith for representing a first vulnerability parameter thereon, whereby a ratio of said calculated environmental parameter to said vulnerability parameter may be calculated, (b) a first of said stationary means and said slide means has a third scale associated therewith for representing a second vulnerability parameter thereon, and (c) the second of said stationary means and said slide means has a third scale thereon for representing the ratio of said environmental parameter to said first vulnerability parameter.

3. Calculating means as recited in claim 2 further comprising conversion means from said ratio between said environmental parameter and said first vulnerability parameter to a number representing the desired probability of damage, said conversion means comprising:

(a) index means on said third scale on said first of said stationary means and said slide means and (b) a fourth scale on said second of said stationary means and said slide means, said fourth scale representing the desired probability of damage, and (c) aligning means for aligning indicia on said third scale of said first of said stationary means and said slide means with indicia on said third and fourth scales on said second of said stationary means with said slide means.

4. Calculating means as recited in claim 3 wherein said one of said slide and stationary means is said slide means and said other of said slide and stationary means is said stationary means.

5. Calculating means as recited in either of claims 3 or 4, wherein said first of said stationary means and said slide means is said slide means, and said second of said stationary and said slide means is said stationary means.

6. Means as recited in claim 1, wherein said distance scales associated with respective ones of said environmental parameter scales are aligned in such manner that, for a selected value of distance, all of said distance scales are in alignment with one another, whereby all of said environmental parameters may be simultaneously calculated for a distance corresponding to said selected value.

* * * * *